US011562763B2

(12) United States Patent
Lee et al.

(10) Patent No.: US 11,562,763 B2
(45) Date of Patent: Jan. 24, 2023

(54) METHOD FOR IMPROVING SOUND QUALITY AND ELECTRONIC DEVICE USING SAME

(71) Applicant: Samsung Electronics Co., Ltd., Gyeonggi-do (KR)

(72) Inventors: Gunwoo Lee, Gyeonggi-do (KR); Hangil Moon, Gyeonggi-do (KR); Sangeun Kim, Gyeonggi-do (KR); Seonmi Kim, Gyeonggi-do (KR); Hwan Shim, Gyeonggi-do (KR); Jaemo Yang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 80 days.

(21) Appl. No.: 17/167,238

(22) Filed: Feb. 4, 2021

(65) Prior Publication Data

US 2021/0249030 A1 Aug. 12, 2021

(30) Foreign Application Priority Data

Feb. 10, 2020 (KR) ..... 10-2020-0015923

(51) Int. Cl.
*G10L 21/0232* (2013.01)
*G10L 25/84* (2013.01)
(Continued)

(52) U.S. Cl.
CPC ..... *G10L 21/0232* (2013.01); *G10L 25/51* (2013.01); *G10L 25/84* (2013.01);
(Continued)

(58) Field of Classification Search
CPC ..... G10L 21/0232; G10L 25/51; G10L 25/84; G10L 2021/02087; G10L 2021/0208;
(Continued)

(56) References Cited

U.S. PATENT DOCUMENTS 6,098,038 A * 8/2000 Hermansky ..... G10L 21/0208 704/226
6,122,384 A * 9/2000 Mauro ..... G10L 21/0232 381/94.1
(Continued)

FOREIGN PATENT DOCUMENTS

JP 2006-113515 A 4/2006
JP 2016-111478 A 6/2016
(Continued)

OTHER PUBLICATIONS

International Search Report dated May 14, 2021.

*Primary Examiner* — Leshui Zhang
(74) *Attorney, Agent, or Firm* — Cha & Reiter, LLC

(57) ABSTRACT

According to certain embodiments, an electronic device comprises a microphone configured to acquire a signal including a voice signal and noise signal; a speaker; a memory; and a processor, wherein the processor is configured to: receive the signal from the microphone, wherein the signal corresponds to a plurality of predetermined frequency bands; identify portions of the signal corresponding to a first band and a second band of the plurality of frequency bands; calculate a signal-to-noise ratio (SNR) values for each predetermined frequency band, based on the signal; obtain a first parameter for correcting the portion of the signal corresponding to the first band and a second parameter for correcting the portion of the signal corresponding to the second band, based on the calculated SNR values for the first band and the second band; and apply the first parameter and the second parameter to each of the predetermined frequency bands.

19 Claims, 9 Drawing Sheets

(51) Int. Cl.

| | |
|---|---|
| ***G10L 25/51*** | (2013.01) |
| ***H04R 1/10*** | (2006.01) |
| ***G10L 21/0208*** | (2013.01) |
| ***H04R 1/26*** | (2006.01) |

(52) U.S. Cl.
CPC ..... *H04R 1/1016* (2013.01); *H04R 1/1041* (2013.01); *G10L 2021/02087* (2013.01); *H04R 2420/07* (2013.01)

(58) Field of Classification Search
CPC ... G10L 2021/02166; G10L 2021/2016; G10L 15/22; G10L 15/20; H04R 1/1016; H04R 1/10; H04R 1/1041; H04R 1/406; H04R 1/40; H04R 1/26; H04R 1/1083; H04R 2420/07; H04R 2420/09; H04R 3/005; H04R 3/00; H04R 25/554; G06F 3/165; G06F 3/167
USPC ..... 704/205, 206, 225, 233, 231; 381/1–23, 381/56, 57, 66, 317, 318, 320, 321, 381/71.12, 71.14, 73.1, 82, 80, 86, 91, 381/92, 94.2, 94.3, 94.5, 94.7, 97, 98, 99, 381/100, 101, 102, 103, 104, 106, 109, 381/110, 111, 112, 113, 114, 115, 119, 381/120, 122; 700/94
See application file for complete search history.

(56) References Cited

U.S. PATENT DOCUMENTS

| | | | | |
|---|---|---|---|---|
| 7,908,139 | B2 | 3/2011 | Jang et al. | |
| 8,326,640 | B2 | 12/2012 | Kong et al. | |
| 9,997,173 | B2 | 6/2018 | Dusan et al. | |
| 10,638,225 | B2 | 4/2020 | Kim | |
| 2004/0175006 | A1 | 9/2004 | Kim et al. | |
| 2011/0191101 | A1* | 8/2011 | Uhle | G10L 21/0208 704/205 |
| 2011/0257967 | A1 | 10/2011 | Every et al. | |
| 2018/0367882 | A1* | 12/2018 | Watts | H04R 1/1016 |
| 2019/0379985 | A1* | 12/2019 | Thomsen | H04R 25/353 |

FOREIGN PATENT DOCUMENTS

| | | | |
|---|---|---|---|
| KR | 10-0546468 | B1 | 1/2006 |
| KR | 10-2013-0061673 | A | 6/2013 |
| KR | 10-1662946 | B1 | 10/2016 |
| KR | 10-1773353 | B1 | 8/2017 |
| KR | 10-1811635 | B1 | 1/2018 |

* cited by examiner

FIG. 6B 611 601

| | | Band 1 | | | | Band N | | |
|---|---|---|---|---|---|---|---|---|
| | | high SNR | ~ | low SNR | | high SNR | ~ | low SNR |
| 621 | Parameter 1 | n1 | ~ | ··· | ··· | ··· | ~ | n(N) |
| 622 | Parameter 2 | m1 | ~ | ··· | | ··· | ~ | m(N) |
| 623 | Parameter 3 | k1 | ~ | ··· | | ··· | ~ | k(N) |
| | ··· | ··· | ~ | ··· | ··· | ··· | ~ | ··· |
| | Parameter Z | z1 | ~ | ··· | ··· | ··· | ~ | z(N) |

METHOD FOR IMPROVING SOUND QUALITY AND ELECTRONIC DEVICE USING SAME

CROSS-REFERENCE TO RELATED APPLICATION(S)

This application is based on and claims priority under 35 U.S.C. 119 to Korean Patent Application No. 10-2020-0015923, filed on Feb. 10, 2020, in the Korean Intellectual Property Office, the disclosure of which is herein incorporated by reference in its entirety.

BACKGROUND

1) Field

Certain embodiments relate to a method for improving sound quality and an electronic device using the same.

2) Description of Related Art

There has been widespread use of various electronic devices, such as smartphones, tablet PCs, portable multimedia players (PMP), personal digital assistants (PDA), laptop personal computers, and wearable devices.

Electronic device can also conduct telephone calls. It is important to provide voice signals that accurately reflect the voice signals of the participants.

The above information is presented as background information only to assist with an understanding of the disclosure. No determination has been made, and no assertion is made, as to whether any of the above might be applicable as prior art with regard to the disclosure.

SUMMARY

An electronic device according to certain embodiments comprises a microphone configured to acquire a signal including a voice signal and noise signal; a speaker; a memory; and a processor, wherein the processor is configured to: receive the signal from the microphone, wherein the signal corresponds to a plurality of predetermined frequency bands; identify portions of the signal corresponding to a first band and a second band of the plurality of frequency bands; calculate a signal-to-noise ratio (SNR) values for each predetermined frequency band, based on the signal; obtain a first parameter for correcting the portion of the signal corresponding to the first band and a second parameter for correcting the portion of the signal corresponding to the second band, based on the calculated SNR values for the first band and the second band; and apply the first parameter and the second parameter to each of the predetermined frequency bands.

According to certain embodiments, a method for improving sound quality when transmitting an outgoing call sound of an electronic device comprises: receiving a signal corresponding to a plurality of predetermined frequency bands from a microphone; identifying a first band and a second band from the received external signal from the plurality of frequency bands; calculating a signal-to-noise ratio (SNR) value for each one of the plurality of predetermined frequency band for the signals; obtaining a first parameter and a second parameter based on the SNR value for the first band and the second band; and applying the first parameter and the second parameter to each of the predetermined frequency bands.

BRIEF DESCRIPTION OF THE DRAWINGS

For a more complete understanding of the disclosure and its advantages, reference is now made to the following description taken in conjunction with the accompanying drawings, in which like reference numerals represent like parts:

FIG. 6B illustrates information on values of parameters corresponding to a frequency band of a method for improving sound quality in a table format according to certain embodiments;

DETAILED DESCRIPTION

An electronic device may output sound data by using a wireless earphone set. The wireless earphone set may include two wireless earphones and a cradle. The two wireless earphones can be configured to wirelessly receive and output sound data. The cradle can receive and charge the two wireless earphones.

When a telephone call is established by the electronic device that is connected to the wireless earphone device, a signal (for example, sound data) coming from the microphone may include not only the user's voice, but also peripheral noise, depending on the environment in which the call is made.

An electronic device is capable of performing transmission/reception during music listening or during a telephone call by using another electronic device (for example, wireless earphone device) connected thereto for short-range communication.

When the user of the electronic device connects a call by using the wireless earphone device, a relatively large amount of components other than the voice may be included due to the physical distance between the microphone and the user's mouth. In an attempt to remove noise other than the voice, an additional module may be included in the electronic device, or the magnitude of the noise signal may be reduced. The attempt to reduce the magnitude of the noise signal of the electronic device, if a call is connected in a harsh situation, may severely distort the user's voice or may incur the inconvenience of remaining noise, consequently degrading the sound quality.

A method for improving sound quality and an electronic device using the same, according to certain embodiments, are advantageous in that, when a telephone call is made after establishing connection for communication with an external electronic device, the state of a signal acquired from the microphone of the electronic device is analyzed, and a correction corresponding to the frequency band is made according to the analyzed signal state. As a result, the noise removing performance of the electronic device is improved, or the sound quality is improved, thereby providing the user of the electronic device and the call recipient with a convenient call-making environment.

Figure 1:
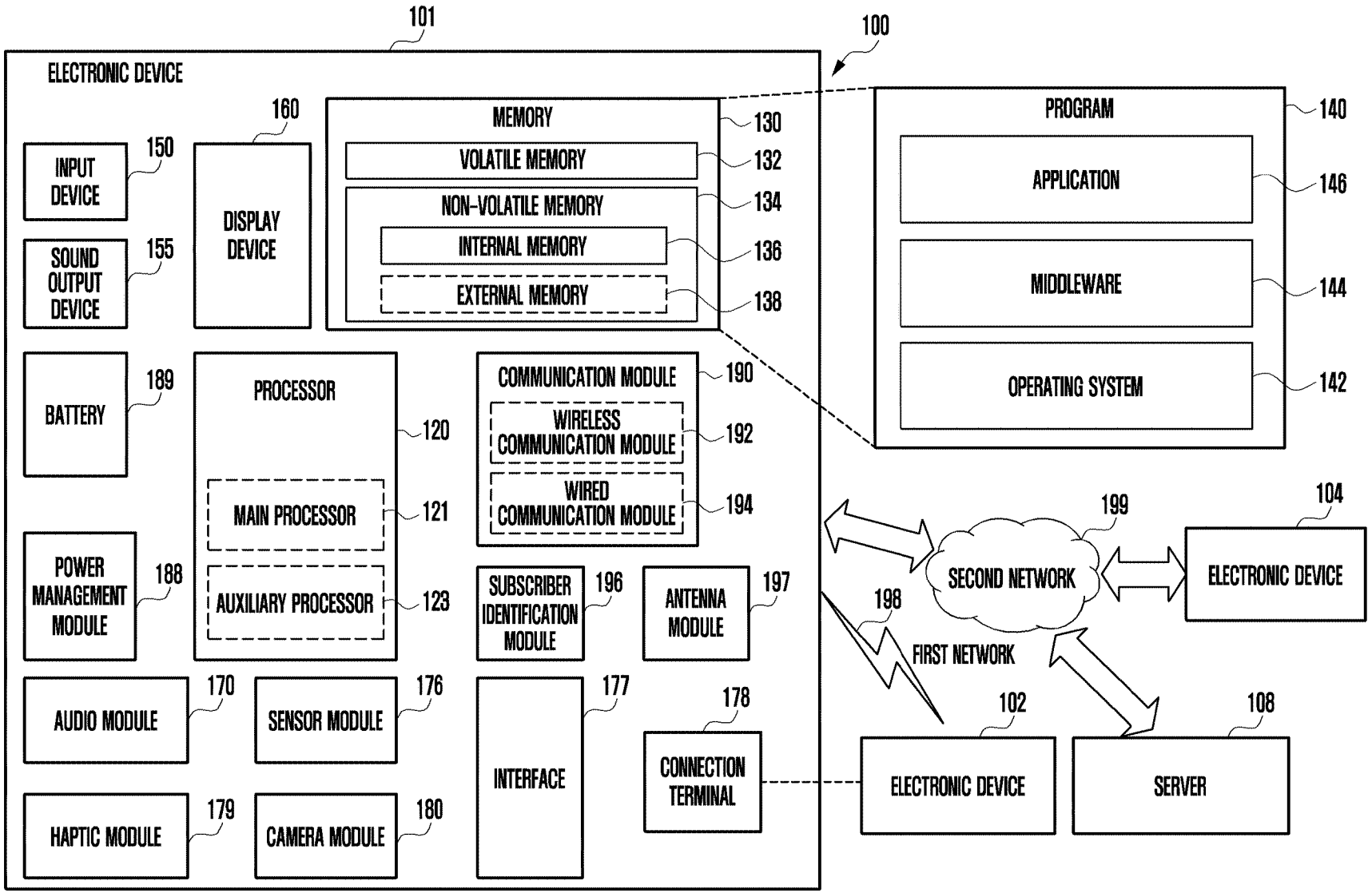
FIG. 1 is a block diagram of an electronic device in a network environment according to certain embodiments.

FIG. 1 is a block diagram illustrating an electronic device 101 in a network environment 100 according to certain embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The term "processor" shall refer to both the singular and plural contexts in this document.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

In certain embodiments, electronic device 102 can comprise one or more wireless earphones. The electronic device 101 can transmit and receive signals from the wireless earphones, using, for example, Bluetooth.

When a telephone call is established by the electronic device 101 that is connected to the wireless earphones, a signal (for example, sound data) coming from a microphone of the wireless earphones may include not only the user's voice, but also peripheral noise, depending on the environment in which the call is made.

When the user of the electronic device connects a call by using the wireless earphone device, a relatively large amount of components other than the voice may be included due to the physical distance between the microphone and the user's mouth. In an attempt to remove noise other than the voice, an additional module may be included in the electronic device to reduce noise. The attempt to reduce the noise signal when a call is connected in a harsh situation, may severely distort the user's voice or may leave a large amount of remaining noise.

Figure 2:
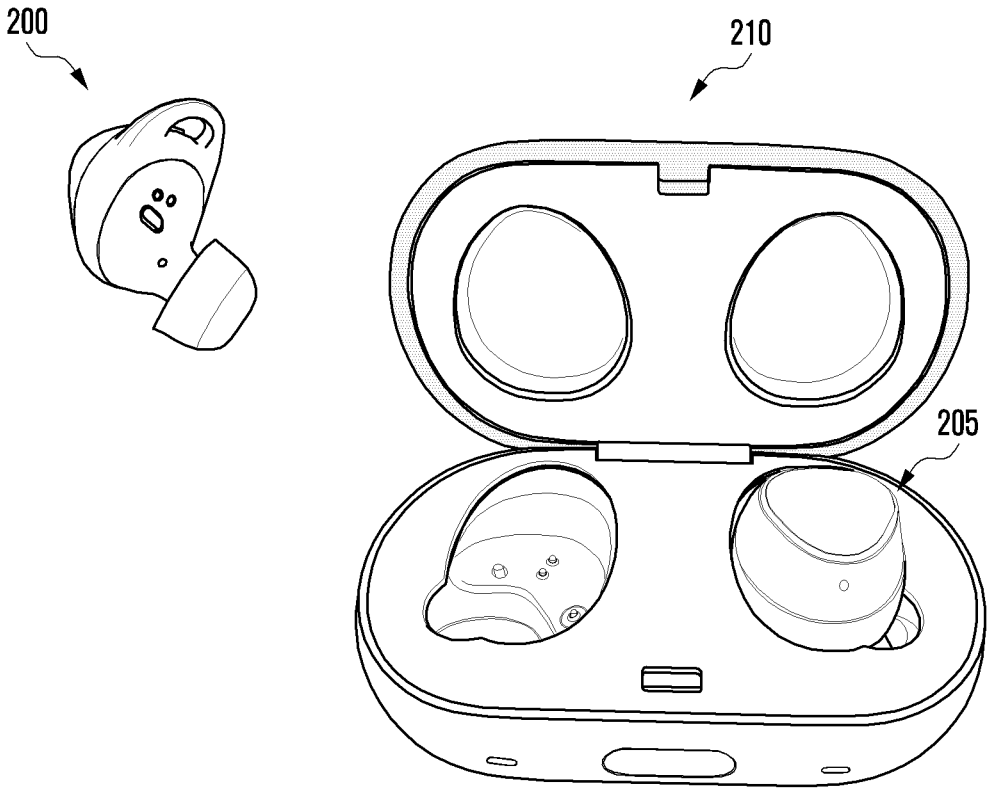
FIG. 2 illustrates an electronic device according to certain embodiments.

FIG. 2 illustrates an electronic device 200 according to certain embodiments.

Referring to FIG. 2, the electronic device 200 (e.g., the electronic device 101 of FIG. 1) may include one or more wireless earphones 205. The electronic device 200 according to an embodiment may have a structure which can be inserted into a cradle 210 (e.g., the electronic device 101 of FIG. 1) to be charged, and may be formed in pairs. The electronic device may include at least a part of the structure and/or functions of the electronic device 101 of FIG. 1.

Referring to FIG. 2, the exterior of the electronic device 200 and the cradle 210 may be formed by a housing structure. The cradle 210 according to an embodiment may include a housing formed in a case shape. According to an embodiment, the housing of the cradle 210 may include a first housing structure having a groove in which the electronic device 200 can be seated, a second housing structure serving as a cover for the first housing structure, and a hinge structure for rotatably coupling the first housing structure with the second housing structure. For example, in an open state in which the second housing structure forms a predetermined angle from the first housing structure, one side of the first housing structure may be connected to one side of the second housing structure through the hinge structure.

According to an embodiment, the electronic device 200 may be seated in the groove formed in the first housing structure of the cradle 210. According to an embodiment, the groove of the first housing structure of the cradle 210 may be formed such that an earplug of the electronic device 200 is inserted into the groove.

The example shown in FIG. 2 may illustrate a state in which the electronic device 200 is seated in the groove formed in the first housing structure of the cradle 210. According to an embodiment, if the electronic device 200 is seated in the groove, the opposite surface of the earplug of the electronic device 200 may be exposed when viewed from above of the first housing structure of the cradle 210.

According to an embodiment, a touch sensor may be disposed on the opposite surface of the earplug of the electronic device 200, and a user may control a function of the electronic device 200 by using the touch sensor. For example, the user may perform a function of the electronic device 200, such as volume control or music selection control, by using the touch sensor in a state where the earplug is inserted into an ear of the user. For another example, since the touch sensor is exposed even in a state where the electronic device 200 is seated in the groove of the cradle 210, the user may control the electronic device 200 by using the touch sensor in the state where the electronic device 200 is seated in the groove. For example, the user may control short-range communication, such as a Bluetooth communication pairing mode, by using the touch sensor in a state where the electronic device 200 is seated in the cradle 210.

As illustrated in FIG. 2, at least one terminal for supplying power to the electronic device 200 may be disposed in the groove of the first housing structure of the cradle 210. For example, the at least one terminal may include a first terminal for supplying a high potential voltage, and a second terminal for supplying a low potential voltage. According to an embodiment, the electronic device 200 may include a terminal which is in physical contact with the at least one terminal while the electronic device is seated in the groove of the first housing structure of the cradle 210. For example, the terminal of the electronic device may include a third terminal which is in physical contact with the first terminal and a fourth terminal which is in physical contact with the second terminal while the electronic device 200 is seated in the groove. According to an embodiment, since the groove of the first housing structure of the cradle 210 is formed such that the earplug of the electronic device 200 is inserted into the groove, the terminal of the electronic device 200 may be formed on the surface on which the earplug is formed (e.g., a surface opposite to the touch sensor), and accordingly, the terminal of the electronic device 200 may be in physical contact with the terminal of the cradle 210 while the electronic device 200 is seated in the groove.

The earphone 205 may be shaped to be received in the human auditory canal and include a speaker and microphone. According to certain embodiments, the earphone 205 can include establish a wireless connection with electronic device 101 by, for example, Bluetooth. The earphone 205 can receive and transmit signals. Specifically, the earphone 205 can receive a signal by the microphone and transmit the signal to the electronic device 101. The signal can include a portion representing a user voice (voice signal) and noise (noise signal).

Figure 3:
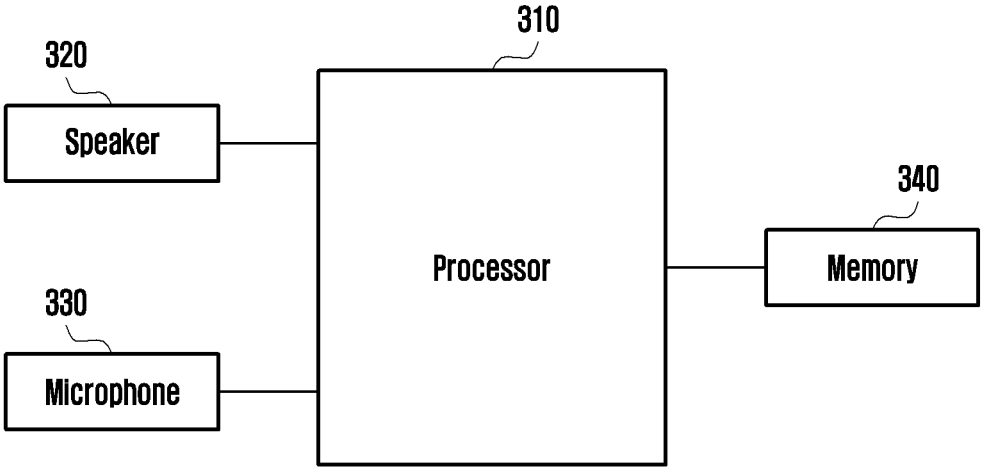
FIG. 3 is a block diagram of an electronic device according to certain embodiments.

FIG. 3 is a block diagram of an electronic device according to certain embodiments.

Referring to FIG. 3, an electronic device (e.g., the electronic device 101 of FIG. 1 and the electronic device 200 of FIG. 2) may include a processor 310 (e.g., the processor 120 of FIG. 1), a speaker 320 (e.g., the audio module 170 of FIG. 1), a microphone 330 (e.g., the audio module 170 of FIG. 1), and a memory 340 (e.g., the memory 130 of FIG. 1), and may include at least a part of the structure and/or functions of the electronic device 101 of FIG. 1 and/or the electronic device 200 of FIG. 2. The components of the electronic device illustrated in FIG. 3 may be omitted or replaced with other components, and are not limited to the illustrated components.

According to certain embodiments, the processor 310 may include a configuration capable of performing a control of each component of the electronic device and/or data processing or an operation relating to communication, and thus include at least a part of the configuration and/or functions of the processor 120 of FIG. 1. The processor 310 may be functionally, operatively, and/or electrically connected to the internal components of the electronic device including the speaker 320, the microphone 330, and the memory 340.

The processor 310 may receive an external signal acquired from the microphone 330 of the electronic device. When the electronic device is communicatively connected with an external electronic device (e.g., a smart phone, and the electronic device 101 of FIG. 1) and enters into a call mode, the processor 310 may acquire a signal from the microphone. The microphone 340 receives an external audio signal and generates an electronic signal (signal) representing the audio signal. The signal can include a voice signal representing a voice audio signal and a noise signal. The scheme in which the electronic device is communicatively connected with the external electronic device may include Bluetooth, Zigbee, and the like, but is not limited thereto. The signal from the microphone can be converted to the frequency domain using Fourier Transforms, thereby resulting in frequency components that correspond to predetermined frequency bands. The predetermined frequency bands may include a first band, a second band, a third band, and an n-th band (where n is a positive integer). According to an embodiment, the predetermined frequency bands may be obtained by dividing a continuous frequency domain by a specific frequency interval in the order of numbers, and high/low frequency bands may be specifically determined regardless of high/low numbers. According to another embodiment, the predetermined frequency bands may be classified into a low-frequency band and a high-frequency band such that, for example, the first band corresponds to a voice band (the frequency band of the human voice), and the second band corresponds to a noise band. However, the foregoing is not limiting and other examples are possible.

The processor 310 may determine whether the signal from the microphone 330 includes a voice signal (represents voice audio). The electronic device may include at least one microphone 330, and an inner microphone (e.g., an in-ear microphone) may be positioned close to an ear of the user of the electronic device to obtain a louder voice being uttered.

The processor 310 may use beamforming to acquire the voice of the user from the signal. The processor may calculate an utterance time delay of at least one pair of microphones (e.g., at least one pair of out-ear microphones) in order to use the beamforming. The beamforming is a technique for acquiring sound in a specific direction, wherein a signal of the front (e.g., a mouth) of the user of the electronic device can be acquired from the at least one pair of microphones (e.g., at least one pair of out-ear microphones). For example, sound is known to travel in dry air at 20 C/68 F at 343 m/s or approximately 1100 ft/s. Based on the distance between the microphones, the speed of sound, and the time delay, an angle can be determined. The pair of microphones used for the beamforming may be positioned at the same distance from the mouth of the user of the electronic device, and the processor may remove a delayed signal by analyzing a delay from an utterance point to the microphones.

The processor 310 may distinguish elements (e.g., noise) excluding the voice of the user from the signal received from the microphone 330. The processor 310 may distinguish noise from the signal (e.g., sound data including noise and the voice of the user of the electronic device) acquired from at least one microphone (e.g., an in-ear microphone, an out-ear microphone, etc.).

An external signal-to-noise ratio (SNR) may indicate a ratio between a voice signal magnitude and a noise signal magnitude. In general, a high SNR value (high SNR) may indicate that less noise is included. According to certain embodiments, the processor 310 may calculate an SNR value from the received signal. The processor 310 may distinguish a first, second, third, or n-th predetermined frequency band from the signal acquired using the microphone 330 of the electronic device, and control to calculate an SNR value by using energy (or power) of the distinguished noise. When calculating an SNR value, the processor 310 may perform a calculation with regard to each predetermined frequency band.

According to certain embodiments, the processor 310 may control correction for improving sound quality in the received external signal. The signal received from the microphone 330 of the electronic device may be acquired with regard to each predetermined frequency band, and an SNR value calculated from the external signal may also be calculated to correspond to a predetermined frequency band.

The processor 310 may calculate a value of a correction parameter (e.g., a first parameter, a second parameter, a third parameter, an n-th parameter, etc.) for improving sound quality on the basis of the calculated SNR value. For example, the processor 310 may configure predetermined sections according to whether the SNR value is high or low such that the sections belong to SNR1 (e.g., $-1<SNR1<1$), SNR2 (e.g., $1<SNR2<2$), SNR3 (e.g., $2<SNR3<3$), SNR(N) (e.g., $3<SNR(N)<4$), for example, and may calculate correction parameters corresponding to respective sections. At least one parameter may be calculated and pre-stored in the memory 340 of the electronic device to specify the type (or number) of the parameter. The reference number used for determining the section of the SNR value is only an example and is not limited thereto. Further, the section of the SNR value may be determined based on a predetermined threshold value of the SNR value as a boundary.

According to another embodiment, the processor 310 may calculate a parameter value for improving sound quality, based on a result of calculating the magnitude of noise included in the received external signal. When the external signal received through the microphone 330 of the electronic device contains a lot of noise, the processor 310 may measure the magnitude (e.g., energy or power) of the noise to calculate a parameter value for correcting the signal. For example, the processor 310 may control to calculate parameter values based on threshold values regarding the magnitude of the noise pre-stored in the memory 340 of the electronic device. When the magnitude of the received noise corresponds to a predetermined threshold value or is included in a section bounded by the threshold value, the processor 310 may control to calculate a parameter value corresponding to the magnitude of the noise by using a pre-stored parameter calculation equation.

According to certain embodiments, the processor 310 may apply the parameter value for improving sound quality to the signal in correspondence with a predetermined frequency band. The processor 310 may apply a parameter value corresponding to a section (or a threshold value) of an SNR value calculated with regard to each predetermined frequency band to the external signal and use the same to improve the sound quality of a signal, including sound improvement. An operation in which the processor 310 applies various parameter values to the external signal may be preconfigured. The voice (e.g., an outgoing call sound) from which noise has been removed may be transmitted to a recipient who is on a call with the user of the electronic device.

According to certain embodiments, the speaker 320 may provide the user with sound data of various applications executable in an external electronic device connected to the electronic device. The sound data may be included in music playback, video playback, and an outgoing and incoming call sound caused by a call.

According to certain embodiments, the microphone 330 may acquire sound data of the user's voice uttered through the electronic device. The microphone 330 of the electronic device may acquire sound data such as the user's voice (voice audio) and noise of an external environment by receiving an audio signal as an input. According to another embodiment, the microphone 330 may include an inner microphone (e.g., an in-ear microphone) and/or an external microphone (e.g., an out-ear microphone). The microphone 330 may use the inner microphone to accurately acquire a voice audio signal.

The memory 340 may be functionally, operatively, and/or electrically connected to the processor 310, and include at least a part of the configuration and/or functions of the memory 130 of FIG. 1.

The memory 340 may store information on types of parameters used when the sound quality of the electronic device using the method for improving sound quality is improved. According to an embodiment, the information on the types of parameters may relate to the types of parameters required to correct an external signal by the processor of the electronic device using the method for improving sound quality. The types of parameters may include a first parameter, a second parameter, a third parameter, and an n-th parameter.

The respective parameters may be calculated with regard to each predetermined frequency band, or may be separately calculated according to an SNR value calculated with regard to each section of the SNR value within the respective bands (e.g., a section divided based on the boundary of threshold values of the SNR value). The memory 340 may store, in a table format, information on values of the parameters (e.g., an experimental value obtained for each section of an SNR value for each predetermined frequency band).

Figure 4:
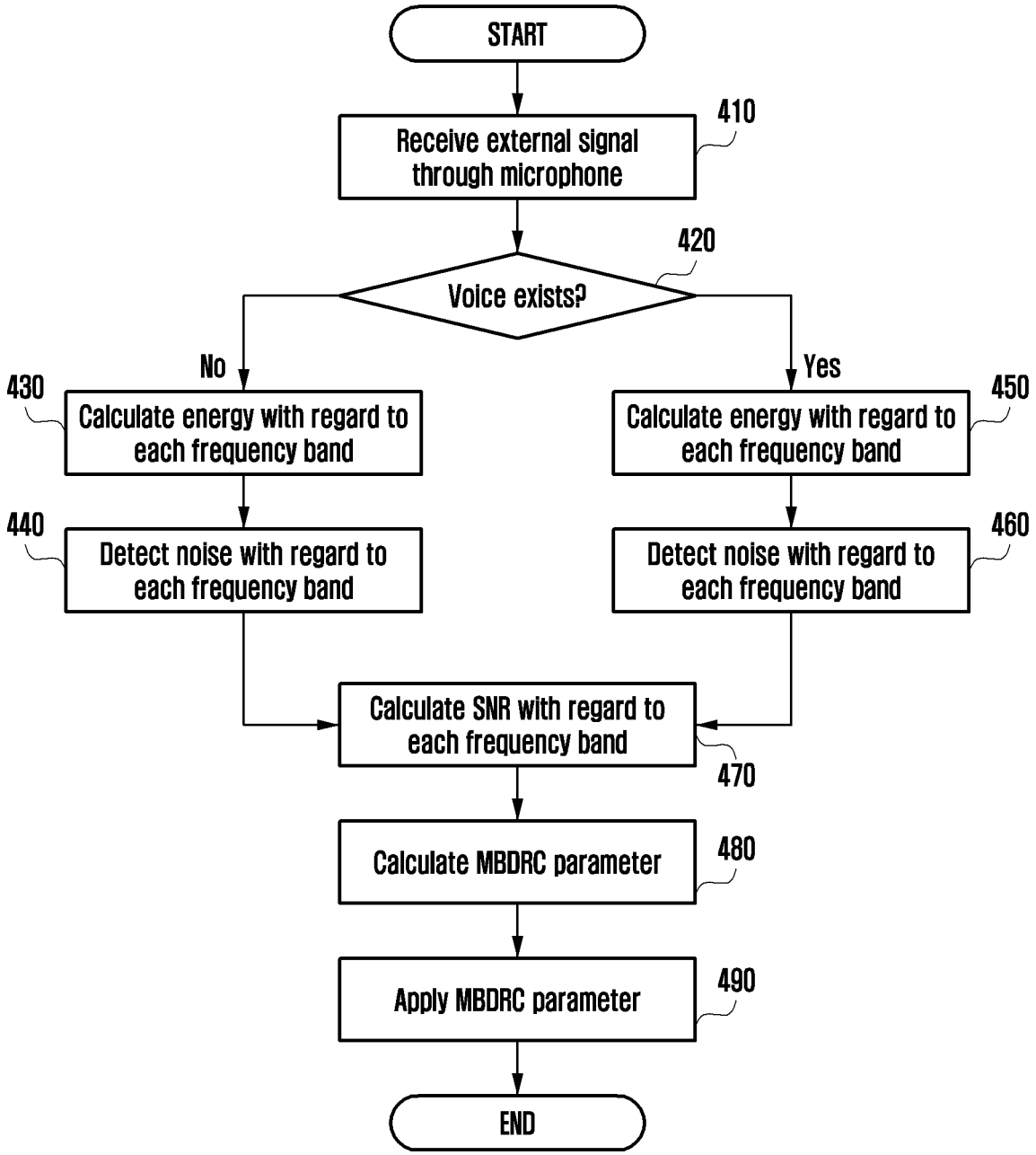
FIG. 4 is a flowchart of a method for improving sound quality according to certain embodiments.

FIG. 4 is a flowchart of a method for improving sound quality according to certain embodiments.

Referring to FIG. 4, a processor (e.g., the processor 120 of FIG. 1 and the processor 310 of FIG. 3) may receive a signal from a microphone which may be included in an electronic device (e.g., the electronic device 101 of FIG. 1 and the electronic device 200 of FIG. 2). For, example, in operation 410, a signal (e.g., including a noise signal and a voice signal, such as a voice signal representing a voice of a user of the electronic device) may be received from the microphone (e.g., the audio module 170 of FIG. 1 and the microphone 330 of FIG. 3). The signal may include a voice signal and/or noise signal representing the external audio environment. The signal may correspond to a plurality of frequency bands. According to certain embodiments, the processor may perform a control through a voice activity detection (VAD) module to determine whether or not the voice of the user exists from the received signal. The VAD module may functionally refer to a software algorithm through which the processor may detect voice activity. The operation of the VAD module according to an embodiment may include an operation of reducing noise through spectrum extraction from the received signal and an operation of calculating a specific shape or quantity from a part of the input signal and then determining whether the specific shape or quantity corresponds to a threshold value or the like. The threshold value relating to the magnitude of the noise may be preconfigured and stored in a memory of the electronic device, and correspond to an experimental value which can reduce the magnitude of the noise of the received signal or prevent a sudden change in the noise in the use of the method for improving sound quality of the electronic device.

The processor may perform a technology applied to voice processing for detecting whether or not a human voice exists from the signal received from the microphone through the VAD module. The VAD processing performed by the VAD module may be referred to as speech detection, and may be used for "voice recognition" or "voice encoding". The VAD may be used to activate voice signal processing or deactivate processors in a non-speech section of audio.

Referring to FIG. 4, the processor may determine whether or not the voice of the user exists from the received external signal. In operation 420, the processor may determine whether or not the voice of the user exists with regard to each predetermined frequency band by using the VAD module. Since the processor performs operation 420 of determining whether or not the voice exists from the external signal, it is possible to effectively estimate (or calculate) the magnitude of noise included in the signal according to whether or not the voice of the user of the electronic device exists in a call situation. According to an embodiment, the processor may receive an external signal with regard to each predetermined frequency band so as to distinguish a voice or noise in each frequency band.

According to an embodiment, the processor may determine whether or not the voice of the user exists from the external signal received through the VAD module, and determine a signal of a partial band as an area in which the voice of the user is abundantly present. The determination of whether or not the voice exists by the processor may be performed according to time (each frame) at which an external signal is received, or may be performed with regard to each predetermined frequency band. The predetermined frequency bands may be configured such that the lower the frequency is, the narrower the frequency band is, and the higher the frequency is, the wider the frequency band is. The method for improving sound quality and the electronic device using the same according to the disclosure can reduce the capacity of the memory of the electronic device or the amount of calculations of the processor by predetermining a frequency band for receiving an external signal.

Referring to FIG. 4, when it is determined that the voice of the user does not exist in the external signal in operation 420, the processor may perform an operation of calculating and/or detecting energy (or power) and noise with regard to each frequency band (operations 430 and 440). For example, the processor may determine whether the voice of the user is included in the external signal, and use a result of the determination to calculate an SNR value or the magnitude of noise with regard to each predetermined frequency band. Referring to FIG. 4, when it is determined that the voice of the user exists in the external signal in operation 420, the processor may perform an operation of calculating and/or detecting energy (or power) and noise with regard to each frequency band (operations 450 and 460).

Referring to FIG. 4, in operation 470, the processor may calculate an SNR value with regard to each predetermined frequency band, based on data calculated through operations 430 to 460. The processor may calculate values of correction parameters for improving sound quality, based on preconfigured sections of the SNR values (operation 480), and the parameters may be referred to as multi-band dynamic range control (MBDRC) parameters. In operation 490, the processor may apply the parameter values calculated through operation 480 to the external signal received with regard to each frequency band to limit the magnitude of noise or suppress excessive change in a noise signal.

The processor according to certain embodiments may apply the calculated MBDRC parameters to the received signal to control the magnitude of the signal with regard to each frequency band. The control of the processor perform in a time domain for the received signal, or perform in a frequency domain. According to an embodiment, in order to perform in the time domain, the electronic device may undergo a process of applying parameters through a signal divided for each frequency by using a filter such as a band pass filter (BPF), so as to add the parameters to the entire frequency band. According to another embodiment, in order to perform in the frequency domain, the electronic device may undergo a process of obtaining a frequency domain signal through a fast Fourier transform (FFT) and applying a parameter, and then correcting a time domain signal as a final output through an inverse fast Fourier transform.

Figure 5:
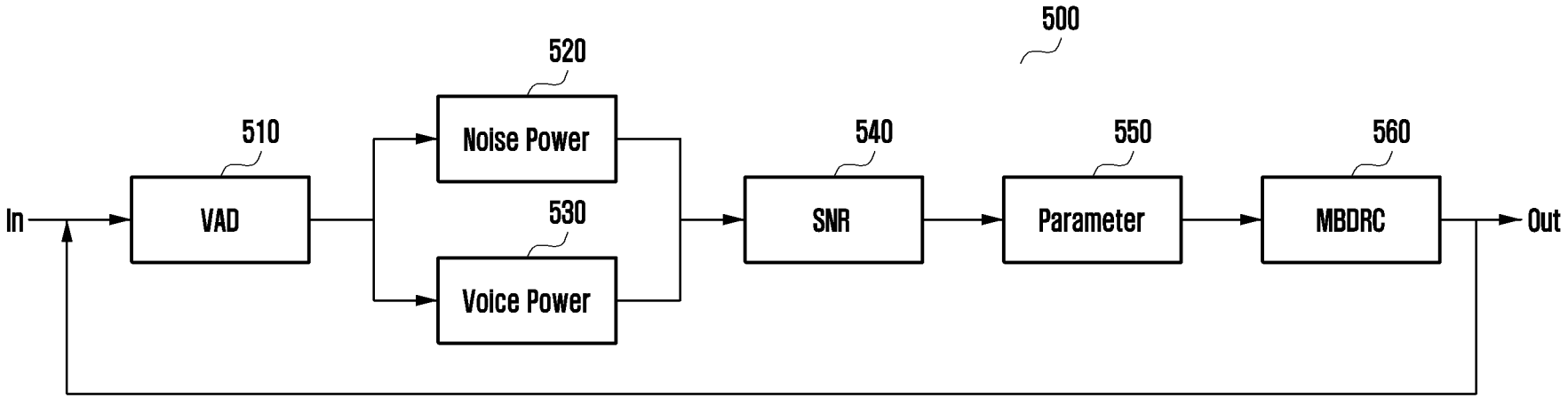
FIG. 5 is a block diagram with regard to each function of performing an operation of an electronic device according to certain embodiments.

FIG. 5 is a functional block diagram 500 for performing an operation of an electronic device according to certain embodiments. The functional block diagram illustrates, in a block form, functions that a processor (e.g., the processor 120 of FIG. 1 and the processor 310 of FIG. 3) of an electronic device (e.g., the electronic device 101 of FIG. 1 and the electronic device 200 of FIG. 2) performs to improve sound quality. The functional block diagram may include a sound quality improvement block, an echo cancellation block, an equalizer block, a mixer block, a buffer block, or the like, but is not limited to the blocks illustrating functions of the electronic device.

Referring to FIG. 5, a voice activity detection module (VAD) 510 of the electronic device may include a function of determining, by the processor, whether the signal includes a voice signal. The processor may receive the voice signal and noise signal from the microphone. In order to increase the accuracy of determining whether or not a voice signal is included in the signal detected by the VAD module of the electronic device, the processor may further include a sensor module (e.g., an acceleration sensor) included in the electronic device, or the processor may receive a result of detection through a separate sensor module. The microphone used to increase the performance of the VAD module may include an inner microphone (e.g., an in-ear microphone) positioned close to an ear of the user of the electronic device, and is less affected by external noise together with the sensor module (e.g., an acceleration sensor) and thus can increase the accuracy in determining whether or not a voice exists in an external signal.

According to certain embodiments, the processor may calculate energy (or power) with regard to each predetermined frequency band by distinguishing the voice of the user and noise from the received external signal. The processor may classify a first frequency band as a voice frequency band and a second frequency band as a noise band, and the predetermined frequency band may be referred to as a predetermined n-th band.

The processor may determine whether or not the voice of the user exists in a signal corresponding to each predetermined frequency band through the VAD module 510, and calculate energy (or power) of noise. Referring to FIG. 5, the processor of the electronic device may calculate energy (or power) of noise by performing a function illustrated as a noise power block 520. According to an embodiment, the processor may calculate energy (or power) of a frequency band excluding the voice of the user determined through the VAD module.

Referring to FIG. 5, the processor may determine whether or not the voice of the user exists in the signal corresponding to each predetermined frequency band through the VAD module 510, and calculate energy (or power) of the voice by using a voice power block 530. The processor of the electronic device may calculate energy (or power) of a voice by performing a function illustrated as the voice power block 530. According to an embodiment, the processor may calculate energy (or power) of a frequency band of the voice of the user determined through the VAD module. According to another embodiment, the voice power block 530 may also perform a calculation other than a calculation result of the noise power block 520. For example, the voice power block 530 may calculate energy (or power) of the entire external signal received through the microphone.

The processor may calculate an external signal-to-noise ratio (SNR) value received with regard to each predetermined frequency band through the microphone. Referring to FIG. 5, the processor may calculate an SNR value of an external signal received with regard to each predetermined frequency band through an SNR block 540.

The processor may calculate the SNR value of the external signal received with regard to each frequency band, and then calculate a value of a parameter according to a predetermined section of the SNR value. According to an embodiment, a functional unit for calculating a value of a parameter by the processor may be referred to as a parameter calculation block 550. The type of parameter may include a first parameter, a second parameter, a third parameter, or an n-th parameter. The respective parameters may be calculated with regard to each predetermined frequency band, and may be separately calculated according to an SNR value calculated with regard to each section of the SNR value within the respective bands. According to another embodiment, information on values of the parameters (e.g., an experimental value obtained for each SNR section with regard to each predetermined frequency band) may be stored in a memory of the electronic device in a table format, and the magnitude of noise may be limited by applying the values of the parameters of the table stored according to a section of an SNR value with regard to each frequency band without a parameter calculation process.

The processor may apply a multi-band dynamic range control (MBDRC) parameter value to the received signal and correct the signal in order to improve sound quality at the time of transmitting an outgoing call sound. Referring to FIG. 5, a functional unit for applying the calculated values of the parameters by the processor may be referred to as an MBDRC block 560. Referring to FIGS. 4 and 5, the processor may control to apply the values of the parameters calculated through operation 480 to the signal corresponding to each frequency band in operation 490, and correct the signal to a signal, thereby limiting the magnitude of the noise.

Referring to FIG. 5, the processor may perform an update to continuously calculate and apply a parameter for sound quality improvement with respect to an external signal received according to time (each frame).

Figure 6A:
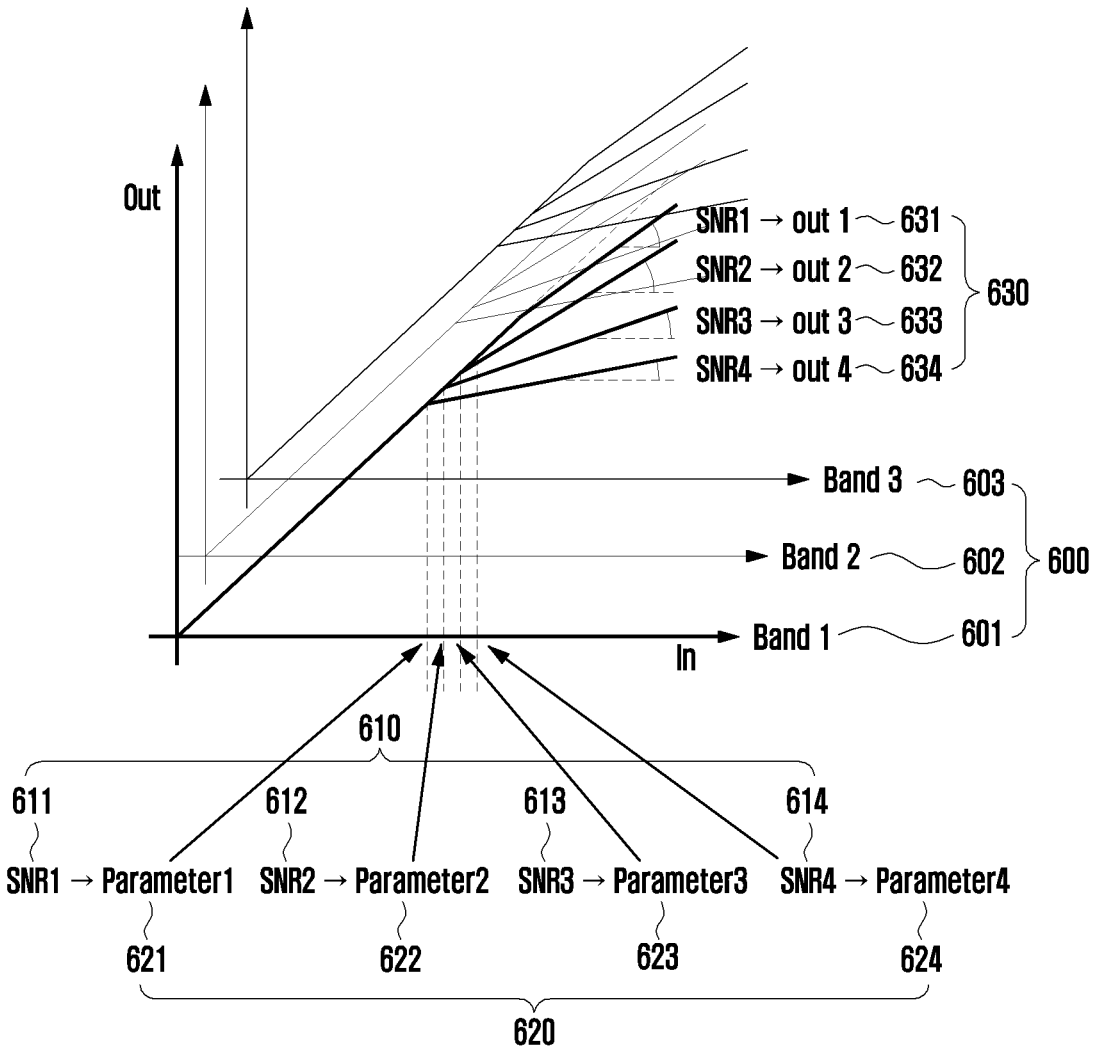
FIG. 6A illustrates an SNR value corresponding to a frequency band and a parameter based on the SNR value of a method for improving sound quality according to certain embodiments.

FIG. 6A illustrates an SNR value corresponding to a frequency band and a parameter based on the SNR value of a method for improving sound quality according to certain embodiments. The horizontal axis is frequency and the vertical axis is SNR.

Referring to FIG. 6A, a processor (e.g., the processor 120 of FIG. 1 and the processor 310 of FIG. 3) of an electronic device (e.g., the electronic device 101 of FIG. 1 and the electronic device 200 of FIG. 2) using a method for improving sound quality may receive an external signal with regard to each predetermined frequency band. In the example shown in FIG. 6A, predetermined frequency bands 600 may include Band 1 601, Band 2 602, and Band 3 603, and sections 610 of SNR values are preconfigured for respective frequency bands, so that values of parameters are different from each other. For example, the processor may control to apply parameter 1 621 when an SNR value of a frequency band of the Band 1 601 corresponds to SNR1 611 (e.g., a section in which predetermined threshold values of SNR values are used as boundary values) among the preconfigured sections of the SNR values, apply parameter 2 622 when the SNR value of the frequency band of the Band 1 corresponds to SNR2 612, apply parameter 3 623 when the SNR value corresponds to SNR3 613, and apply parameter 4 624 when the SNR value corresponds to SNR4 614. Parameter n 620 shown in FIG. 6A may correspond to an n-th parameter.

Referring to FIG. 6A, the processor may calculate values 620 of parameters corresponding to the sections 610 of the SNR values with regard to each predetermined frequency band 600, and apply the values to a signal received from a microphone of the electronic device. For example, when an SNR value with regard to each frequency band 600 of the signal received by the processor is included in the SNR1 611 among the preconfigured sections 610 of the SNR values, the signal may be out 1 631 by application of the value of the parameter 1 621, when the SNR value is included in the SNR2 612, the signal may be out 2 632 by application of the value of the parameter 2 622, when the SNR value is included in the SNR3 613, the signal may be out 3 633 by application of the value of the parameter 3 623, and when the SNR value is included in the SNR4 614, the signal may be out 4 634 by application of the value of the parameter 4 624. The description in which values 630 of signals corrected using the method for improving sound quality are described as the out 1 631, out 2 632, out 3 633, and out 4 634 is only an example and is not limited thereto. The same and/or similar manner may be applied even when the electronic device according to certain embodiments calculates a value of a parameter on the basis of the magnitude (energy or power) of noise of a received signal, instead of calculating an SNR value, or reads values of parameters pre-stored in the memory so as to use the method for improving sound quality.

According to certain embodiments, values of parameters calculated by the processor may be indicators that can be used for correction to improve sound quality during transmission of an outgoing call sound. According to an embodiment, the types of parameters may include limit threshold, attack time, release time, boost gain, knee point, smoothing parameter, and the like. The calculated MBDRC parameters optimized for the noise magnitude (energy or power) with regard to each frequency band may be additionally provided or replaced in addition to the types listed above.

According to certain embodiments, the processor of the electronic device using the method for improving sound quality may calculate and apply an MBDRC parameter with regard to each received frequency band. According to an embodiment, a limit threshold parameter among the MBDRC parameters may be a value that limits the maximum size of a signal. For example, when a value of the limit threshold parameter is low, the maximum size value of a signal is limited to be small, and when the value of the limit threshold parameter is high, the maximum size value of the signal is limited to be large. According to an embodiment, an attack time parameter among the MBDRC parameters may be a value that, when a gain to be applied to a corresponding frequency band increases, adjusts the time taken until the increased gain is reflected. For example, if an attack time parameter value is small, the time taken to increase until the gain reaches a newly calculated value is shortened, so that the gain may be applied within a short time, and if the attack time parameter value is large, the time taken to apply the increased gain may be relatively long. According to an embodiment, when a gain to be applied to a predetermined frequency band decreases, a release time parameter among the MBDRC parameters may be a value that adjusts the time taken until the decreased gain is reflected. For example, when a release time parameter value is small, the time taken until the decreased gain is applied is short, and in the opposite case, the time taken until the decreased gain is applied may be longer.

According to certain embodiments, when the processor applies the calculated MBDRC parameter values, the processor may separately apply the MBDRC parameter values according to sections of SNR values. According to an embodiment, the processor may control to maintain the original sound quality and volume of a received signal by calculating a high limit threshold parameter value, a low attack time parameter value, and a low release time parameter value in the case of a section where an SNR value is high. In another embodiment, in the case of a section where an SNR value is low, the processor may control to limit excessive change in the magnitude of the original volume or noise of a received signal by calculating a low limit threshold parameter value, a high attack time parameter value, and a high release time parameter value.

According to certain embodiments, a boost gain parameter among the MBDRC parameters may be a value that determines the degree to which the magnitude of a signal is amplified. For example, when a boost gain parameter value is increased or decreased by A, the magnitude of the signal received by the electronic device may be increased or decreased by A.

A knee point parameter among the MBDRC parameters may be a value that can flatten a signal with regard to each frequency band received by the electronic device. Referring to FIG. 6A, a graph of a signal with regard to each frequency band predetermined by the method for improving sound quality of the disclosure may have a bending point after correction by the MBDRC parameters. The knee point parameter among the MBDRC parameters has a value capable of amplifying or attenuating the magnitude of a signal at the bending point, so that the graph as shown in FIG. 6A may be illustrated.

A smoothing parameter among the MBDRC parameters may be a value for determining a ratio in which the magnitude of an input signal at the current time point (a frame in which the signal is received) is reflected to the final magnitude in the process of calculating the magnitude (or energy) of the signal. For example, as a smoothing parameter value decreases, a ratio in which the magnitude of the signal at the current time point is reflected may increase, and as the smoothing parameter value increases, the ratio in which the magnitude of the signal at the current time point is reflected may decrease.

FIG. 6B illustrates information on values of parameters corresponding to a frequency band of a method for improving sound quality in a table format according to certain embodiments. For a given frequency band, the SNR is measured. For each given band, band 1 . . . N, the SNR can be looked up in the columns corresponding to the column of the given band (high SNR, low SNR) and the row (limit threshold, attack time, release time). Table 1 below shows an exemplary value of the table given by FIG. 6B.

TABLE 1

| | Band 1 | | | | Band N | | |
|---|---|---|---|---|---|---|---|
| | high SNR | | low SNR | | high SNR | | low SNR |
| limit threshold | −10 | ~ | −12 | . . . | −50 | ~ | −60 |
| attack time | 0.5 | ~ | 0.6 | | 0.5 | ~ | 0.95 |
| release time | 0.01 | ~ | 0.09 | | 0.01 | ~ | 0.9 |

Referring to FIG. 6B, a method for improving sound quality and an electronic device using the same may use, without calculating values of parameters for correcting an external signal received with regard to each predetermined frequency band through a processor, the parameter values 620 in a state stored in a table format in a memory (e.g., the memory 130 of FIG. 1 and the memory 340 of FIG. 3).

Referring to FIG. 6B, a parameter for correcting noise of an external signal received by the electronic device using the method for improving sound quality may include parameter 1, parameter 2, parameter 3, and parameter Z. The MBDRC parameters may have different values according to an SNR value calculated with regard to each predetermined frequency band 600. For example, the parameter 1 621 may be stored as an experimental value ranging from a value of n1 in the Band 1 601 to a value of n(N) in Band N. Referring to FIG. 6B, values according to the calculated SNR values with regard to each frequency band up to the parameter Z other than the parameter 1 621, parameter 2 622, and parameter 3 623 may be experimental values for improving sound quality of the received signal, and may be stored, in a table format as shown, in the memory of the electronic device using the method for improving sound quality.

Referring to FIGS. 6A and 6B, the MBDRC parameter values for improving sound quality when the electronic device transmits an outgoing call sound may be calculated by analyzing an external signal received with regard to each frame, or a table pre-optimized by experimental values may be stored in the memory, and thus read and applied by the processor.

Referring to the table shown in FIG. 6B, a high SNR 611 and a low SNR indicate the relative highs and lows of the SNR values calculated with regard to each frequency band, and a predetermined section of an SNR value is not necessarily divided into two types, high and low. In addition, the predetermined section of the SNR value may be configured by using, as boundary values, threshold values of continuous SNR values ranging from a high SNR section to a low SNR section.

Figure 7A:
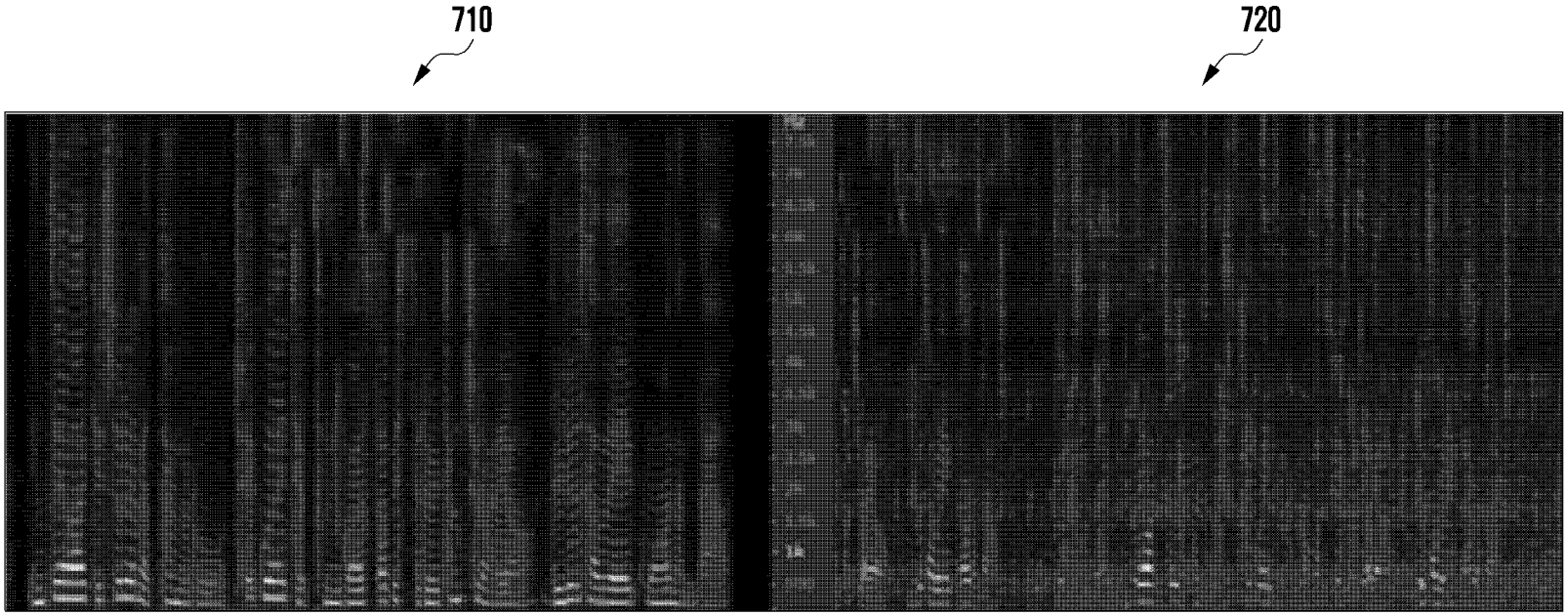
FIG. 7A illustrates a signal input to an electronic device before application of a method for improving sound quality according to certain embodiments.

FIG. 7A illustrates a signal input to an electronic device before application of a method for improving sound quality according to certain embodiments. The method for improving sound quality according to certain embodiments may include receiving an external signal with regard to each predetermined frequency band. Referring to FIG. 7A, as illustrated in the form of a 3D spectrum, a horizontal axis (x-axis) direction may indicate time (frame), and a vertical axis (y-axis) direction may indicate frequency. According to an embodiment, the frequency in the vertical axis direction may represent a lower frequency band as the frequency is closer to the horizontal axis, and represent a higher frequency band as the frequency is farther from the horizontal axis.

According to certain embodiments, a low-frequency band of an external signal received by an electronic device (e.g., the electronic device 101 of FIG. 1 and the electronic device 200 of FIG. 2) may contain a greater amount of a voice of a user of the electronic device than noise. The electronic device using the method for improving sound quality may be configured to receive an external signal with regard to each predetermined frequency band in order to improve the quality of an outgoing call sound of the user of the electronic device. According to an embodiment, a section obtained by dividing the vertical axis (y-axis) of FIG. 7A by a predetermined interval may correspond to a predetermined frequency band used in the method for improving sound quality.

Referring to FIG. 7A, a left region 710 bounded by a band portion drawn in the middle of the horizontal axis (x-axis) of the illustrated diagram shows a voice in a quiet situation, and a voice signal occupies most of the entire band. On the other hand, a right region 720 shows a voice in a noisy situation, and a voice signal and a noise signal are mixed. According to an embodiment, the left region 710 of the band portion may contain a relatively large amount of voice, and the right region 720 may contain a relatively large amount of noise. In particular, the higher the frequency band is, the greater the magnitude of the noise signal compared to the voice signal. For example, the left region 710 of the band portion may be referred to as a high SNR environment in which an SNR is relatively high, and the right region 720 may be referred to as a low SNR environment in which an SNR is relatively low. Alternatively, even in the right region 720, a low-frequency band having large voice energy may be referred to as a high SNR environment, and a high-frequency band having relatively small voice energy may be referred to as a low SNR environment.

Figure 7B:
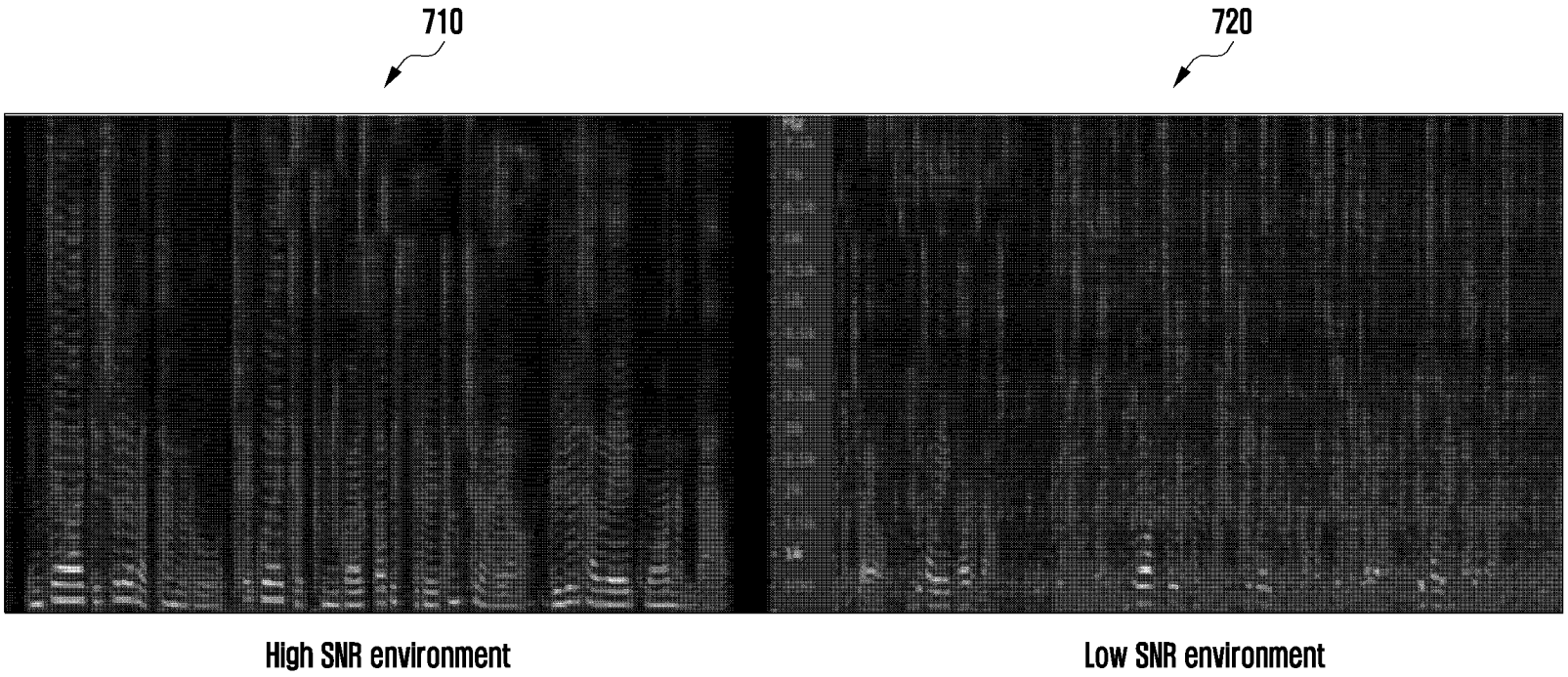
FIG. 7B illustrates a signal output from an electronic device after application of a method for improving sound quality according to certain embodiments.

FIG. 7B illustrates a signal output from an electronic device after application of a method for improving sound quality according to certain embodiments.

Referring to FIGS. 7A and 7B, since a voice is clean in the entire frequency band in a high SNR environment 710, correction for sound quality improvement may not be applied or a small MBDRC parameter value may be applied. For example, in the high SNR environment 710, among MBDRC parameters, a limit threshold parameter value may be slightly increased and an attack time parameter value and a release time parameter value may be slightly reduced, and the parameter values may be applied to a received signal with regard to each frequency so as to maintain the quality of a voice of a user or to correct the same more clearly. Referring to FIGS. 7A and 7B, it can be seen that, in the illustrated diagrams of the high SNR environment 710, the signal in the low-frequency band is emphasized in FIG. 7B than in FIG. 7A and thus corrected.

Referring to FIGS. 7A and 7B, since a voice and noise are scattered in the entire frequency band and are unclearly present (babble) in a low SNR environment 720, correction for sound quality improvement may be applied. For example, in the case of a high-frequency band in the low SNR environment 720, since an SNR value is very low, mostly, only noise may remain or only irregular noise may remain, even when sound quality improvement (noise suppression) is performed. In order to greatly improve sound quality in the high-frequency band of the low SNR environment 720, a processor (e.g., the processor 120 of FIG. 1 and the processor 310 of FIG. 3) of an electronic device (e.g., the electronic device 101 of FIG. 1 and the electronic device 200 of FIG. 2) may control to decrease a limit threshold parameter among the MBDRC parameters and increase an attack time parameter value and a release time parameter value to apply the values to the received signal in the high-frequency band such that only smoother residual noise remains.

According to an embodiment, in the case of a low-frequency band in the low SNR environment 720, since an SNR value is higher than that of the high-frequency band, the MBDRC parameters may be applied in consideration of determination of whether or not the user's voice exists. For example, even in the low SNR environment 720, there may be a greater amount of the user's voice than noise in the low-frequency band, but when it is determined as a very low SNR environment 720 with only noise and no voice, the processor of the electronic device may control to improve sound quality by significantly increasing a limit threshold parameter value and a release time parameter value among the MBDRC parameters and significantly decreasing an attack time parameter value to apply the values to the received signal in the low-frequency band. In another embodiment, when a weak voice signal and a strong noise signal exist in the low-frequency band in the low SNR environment 720, the processor of the electronic device may control to improve sound quality by slightly increasing a limit threshold parameter value and a release time parameter value among the MBDRC parameters and slightly decreasing an attack time parameter value to apply the values to the received signal in the low-frequency band. The term "significantly" or "slightly" for describing the relative size of the application of the parameter value is used to compare parameter values calculated by the processor or parameter values stored in advance, but is not limited to a specific constant value.

Referring to FIGS. 7A and 7B, the processor may control correction of a signal in which noise in the high-frequency band is removed and a voice part of the low-frequency band is emphasized in the high SNR environment 710 by using the method for improving sound quality. For another embodiment, the processor may use the method for improving sound quality to improve sound quality of the high-frequency band in the low SNR environment 720, and control correction of a signal by applying variable parameter values in the case where the user's voice exists or does not exist in the low-frequency band. The electronic device using the method for improving sound quality according to such an SNR environment may calculate parameters according to an SNR calculation value of a received signal to correct the signal, may apply values of parameters pre-stored in the memory to correct the signal, or may determine whether the magnitude of noise of the received signal corresponds to a predetermined threshold value and apply the values of the pre-stored parameters so as to correct the signal.

According to certain embodiments, a method for improving sound quality and an electronic device using the same may control to maintain the volume or sound quality with respect to a section where an SNR value is high or a frequency band having a high SNR value. In addition, the method for improving sound quality and the electronic device using the same may control correction to reduce the volume or excessive change in a noise signal with respect to a section where an SNR value is low or a frequency band having a low SNR value. The method for improving sound quality and the electronic device using the same according to certain embodiments may apply a variable parameter value to improve the quality of a voice delivered to a person who is on a call with a user of the electronic device.

An electronic device according to certain embodiments may include: a microphone configured to acquire an external signal including a voice of a user of the electronic device and noise; a speaker; a memory; and a processor, wherein the processor is configured to: receive the external signal acquired through the microphone with regard to each predetermined frequency band; determine whether or not the voice of the user exists, based on the received external signal; identify a first band and a second band from the received external signal; calculate an external signal-to-noise ratio (SNR) value with regard to each predetermined frequency band, based on the received external signal; obtain a first parameter for correcting a signal of the identified first band and a second parameter for correcting a signal of the identified second band, in correspondence with the calculated value; and apply the obtained parameters to the received external signal with regard to each frequency band to transmit an outgoing call sound having improved sound quality.

The processor of the electronic device according to certain embodiments may be configured to obtain the first parameter and the second parameter, based on a magnitude of the noise included in the received external signal when obtaining the first parameter and the second parameter. The microphone of the electronic device according to certain embodiments may include an inner microphone and further include a sensor module, and the processor may be configured to determine whether or not the voice of the user exists, by using the microphone or the sensor module when receiving the external signal.

In the memory of the electronic device according to certain embodiments, information on types of parameters obtained to correct the received external signal may be pre-stored. In the memory of the electronic device according to certain embodiments, information on values of the parameters may be pre-stored in order to correct the received external signal.

The processor of the electronic device according to certain embodiments may be configured to obtain the values of the parameters according to a predetermined threshold value of the external signal-to-noise ratio (SNR) value, based on the calculated external signal-to-noise ratio (SNR) value. The processor of the electronic device according to certain embodiments may be configured to obtain the values of the parameters by determining whether the magnitude of the noise included in the received signal corresponds to a predetermined threshold value. The processor of the electronic device according to certain embodiments may be configured to receive the parameters obtained for correction of the received external signal or the information on the values of the parameters pre-stored in the memory and apply the received parameters or information to the external signal. The processor of the electronic device according to certain embodiments may be configured to update and apply the parameters according to the received external signal. The electronic device according to certain embodiments may include a short-range communication module, and the processor of the electronic device may be configured to be communicatively connected with an external electronic device through the short-range communication module.

A method for improving sound quality according to certain embodiments may include the operations of: when transmitting an outgoing call sound of an electronic device, receiving an external signal with regard to each predetermined frequency band by using a microphone; determining whether or not a voice of a user exists, based on the received external signal; identifying a first band and a second band from the received external signal; calculating an external signal-to-noise ratio (SNR) value with regard to each predetermined frequency band, based on the received external signal; obtaining a first parameter for correcting a signal of the identified first band and a second parameter for correcting a signal of the identified second band, in correspondence with the calculated value; and applying the obtained parameters to the received external signal with regard to each frequency band.

The obtaining operation of the method for improving sound quality according to certain embodiments may include an operation of obtaining the parameters based on a magnitude of noise included in the received external signal. The determining operation of the method for improving sound quality according to certain embodiments may include an operation of receiving the external signal by using an inner microphone or a sensor module, so as to determine whether or not the voice of the user exists.

The obtaining operation of the method for improving sound quality according to certain embodiments may include an operation of receiving information on types of the obtained parameters from a memory. The applying operation of the method for improving sound quality according to certain embodiments may include an operation of receiving and applying values of parameters pre-stored in the memory to correct the received external signal.

The obtaining operation of the method for improving sound quality according to certain embodiments may include an operation of obtaining the parameters according to a predetermined threshold value of the external signal-to-noise ratio (SNR) value, based on the calculated external signal-to-noise ratio (SNR) value. The obtaining operation of the method for improving sound quality according to certain embodiments may include an operation of obtaining values of the parameters by determining whether the magnitude of the noise included in the received signal corresponds to the predetermined threshold value.

The applying operation of the method for improving sound quality according to certain embodiments may include an operation of receiving the parameters obtained for correction of the received external signal or information on the values of the parameters pre-stored in the memory of the electronic device, and applying the received parameters or information to the external signal. The applying operation of the method for improving sound quality according to certain embodiments may include an operation of updating and applying the values of the parameters according to the received external signal. The method for improving sound quality according to certain embodiments may include an operation of establishing connection for communication with an external electronic device by using a short-range communication module included in the electronic device.

According to certain embodiments, an electronic device comprises a microphone configured to acquire a signal including a voice signal and noise signal; a speaker; a memory; and a processor, wherein the processor is configured to: receive the signal from the microphone, wherein the signal corresponds to a plurality of predetermined frequency bands; identify portions of the signal corresponding to a first band and a second band of the plurality of frequency bands; calculate a signal-to-noise ratio (SNR) values for each predetermined frequency band, based on the signal; obtain a first parameter for correcting the portion of the signal corresponding to the first band and a second parameter for correcting the portion of the signal corresponding to the second band, based on the calculated SNR values for the first band and the second band; and apply the first parameter and the second parameter to each of the predetermined frequency bands.

According to certain embodiments, the processor is configured to obtain the first parameter and the second parameter, based on a magnitude of the noise included in the signal.

According to certain embodiments, the microphone comprises an inner microphone and further comprises a sensor module, and the processor is configured to determine whether or not a voice signal exists by using the microphone or the sensor module when receiving the signal.

According to certain embodiments, indicators of the first parameter and the second parameter are pre-stored in the memory.

According to certain embodiments, the processor is configured to obtain the parameters according to a predetermined threshold values of the signal-to-noise ratio (SNR) value, based on the calculated signal-to-noise ratio (SNR) value.

According to certain embodiments, the processor is configured to obtain the parameters by determining whether the magnitude of the included noise corresponds to a predetermined threshold value.

According to certain embodiments, indicators of the values of the first parameter and the second parameter are pre-stored in the memory.

According to certain embodiments, the processor is configured to receive the first parameter and second parameter from the memory and apply the received first parameter and second parameter to the signal.

According to certain embodiments, the processor is configured to update and apply the first parameter and the second parameter according to the received external signal.

According to certain embodiments, the electronic device further comprises a short-range communication module, wherein the processor is communicatively connected with an external electronic device through the short-range communication module.

According to certain embodiments, a method for improving sound quality when transmitting an outgoing call sound of an electronic device comprises: receiving a signal corresponding to a plurality of predetermined frequency bands from a microphone; identifying a first band and a second band from the received external signal from the plurality of frequency bands; calculating a signal-to-noise ratio (SNR) value for each one of the plurality of predetermined frequency band for the signals; obtaining a first parameter and a second parameter based on the SNR value for the first band and the second band; and applying the first parameter and the second parameter to each of the predetermined frequency bands.

According to certain embodiments, the obtaining comprises obtaining the first parameter and the second parameter based on a magnitude of noise included signal.

According to certain embodiments, the method further comprises determining whether the signal includes the voice signal using an inner microphone or a sensor module.

According to certain embodiments, the obtaining comprises receiving indictors of the first parameter and the second parameter from a memory.

According to certain embodiments, the obtaining comprises obtaining the parameters according to a predetermined threshold value of the signal-to-noise ratio (SNR) value, based on the calculated signal-to-noise ratio (SNR) value.

According to certain embodiments, the obtaining further comprises obtaining the parameters by determining whether the magnitude of the included noise corresponds to a predetermined threshold value.

According to certain embodiments, the applying comprises receiving and applying values of the parameters pre-stored in a memory.

According to certain embodiments, the method further comprises receiving the first parameter and the second parameter inform the memory and applying the received first parameter and second parameter to the external signal.

According to certain embodiments, the applying comprises updating and applying the first parameter and the second parameter according to the external signal.

According to certain embodiments, the method further comprises establishing connection for communication with an external electronic device by using a short-range communication module included in the electronic device.

Although exemplary embodiments of the present invention have been described in detail, it should be clearly understood that many variations and/or modifications of the basic inventive concepts herein taught which may appear to those skilled in the present art will still fall within the spirit and scope of the present invention, as defined in the appended claims.

What is claimed is:

1. An electronic device comprising:

a microphone comprising an inner microphone and a sensor module and configured to acquire a signal including a voice signal and a noise signal;

a speaker;

a memory; and a processor, wherein the processor is configured to:

receive the signal from the microphone, wherein the signal corresponds to a plurality of predetermined frequency bands, identify portions of the signal corresponding to a first band and a second band of the plurality of predetermined frequency bands, calculate signal-to-noise ratio (SNR) values for each predetermined frequency band, based on the signal, determine a first parameter for correcting a portion of the signal corresponding to the first band and a second parameter for correcting a portion of the signal corresponding to the second band, based on the calculated SNR values for the first band and the second band, wherein the first parameter and the second parameter are dynamic range control parameters and apply the first parameter and the second parameter to each of the plurality of predetermined frequency bands, wherein the processor is further configured to:

when the calculated SNR values for each predetermined frequency band are lower than a threshold, determine whether or not the received signal includes the voice signal by using the microphone and adjust the second parameter based on the existence of the voice signal, wherein a frequency of the second band is lower than a frequency of the first band.

2. The electronic device of claim 1, wherein the processor is configured to obtain the first parameter and the second parameter, based on a magnitude of noise included in the signal.

3. The electronic device of claim 2, wherein the processor is configured to obtain the first parameter and the second parameter by determining whether the magnitude of included noise corresponds to a predetermined threshold value.

4. The electronic device of claim 1, wherein indicators of the first parameter and the second parameter are pre-stored in the memory.

5. The electronic device of claim 1, wherein the processor is configured to obtain the first parameter and the second parameter according to predetermined threshold values of SNR values, based on the calculated SNR value.

6. The electronic device of claim 1, wherein indicators of values of the first parameter and the second parameter are pre-stored in the memory.

7. The electronic device of claim 6, wherein the processor is configured to receive the first parameter and second parameter from the memory and apply the received first parameter and second parameter to the signal.

8. The electronic device of claim 1, wherein the processor is configured to update and apply the first parameter and the second parameter according to the received signal.

9. The electronic device of claim 1, further comprising a short-range communication module, wherein the processor is communicatively connected with an external electronic device through the short-range communication module.

10. A method for improving sound quality when transmitting an outgoing call sound of an electronic device, the method comprising:

receiving a signal corresponding to a plurality of predetermined frequency bands from a microphone;

identifying a first band and a second band from the signal from the plurality of predetermined frequency bands;

calculating signal-to-noise ratio (SNR) values for each one of the plurality of predetermined frequency bands for the signal;

determining a first parameter and a second parameter based on the calculated SNR values for the first band and the second band, wherein the first parameter and the second parameter are dynamic range control parameters; and applying the first parameter and the second parameter to each of the plurality of predetermined frequency bands, wherein the method further comprises, when the calculated SNR values for each predetermined frequency band are lower than a threshold, determining whether or not the received signal includes a voice signal by using the microphone and adjusting the second parameter based on the existence of the voice signal, wherein a frequency of the second band is lower than a frequency of the first band.

11. The electronic device of claim 1, wherein the first parameter and the second parameter are selected from a group consisting of limit threshold, attack time, and release time.

12. The method of claim 10, wherein obtaining comprises obtaining the first parameter and the second parameter based on a magnitude of noise included.

13. The method of claim 12, wherein obtaining further comprises obtaining the first parameter and second parameter by determining whether the magnitude of included noise corresponds to a predetermined threshold value.

14. The method of claim 10, wherein obtaining comprises receiving indictors of the first parameter and the second parameter from a memory.

15. The method of claim 10, wherein obtaining comprises obtaining the first parameter and second parameter according to a predetermined threshold value of the SNR value, based on the calculated SNR value.

16. The method of claim 10, wherein applying comprises receiving and applying values of the first parameter and the second parameter pre-stored in a memory.

17. The electronic device of claim 16, wherein applying further comprises receiving the first parameter and the second parameter form the memory and applying the received first parameter and second parameter to the signal.

18. The method of claim 10, wherein applying comprises updating and applying the first parameter and the second parameter according to the signal.

19. The method of claim 10, further comprising establishing connection for communication with an external electronic device by using a short-range communication module included in the electronic device.

* * * * *